US007999452B2

(12) United States Patent
Naito

(10) Patent No.: US 7,999,452 B2
(45) Date of Patent: Aug. 16, 2011

(54) CONNECTING MEMBER IMPROVED IN ASSEMBLABILITY WITH RESPECT TO A CONNECTION OBJECT AND A COMBINATION THEREOF

(75) Inventor: Takeharu Naito, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 529 days.

(21) Appl. No.: 12/214,055

(22) Filed: Jun. 16, 2008

(65) Prior Publication Data

US 2008/0309215 A1 Dec. 18, 2008

(30) Foreign Application Priority Data

Jun. 18, 2007 (JP) ..... 2007-160102

(51) Int. Cl.
*H01J 65/00* (2006.01)

(52) U.S. Cl. ..... 313/234; 313/607; 313/634

(58) Field of Classification Search ..... 313/234, 313/491–493, 607, 634
See application file for complete search history.

(56) References Cited

U.S. PATENT DOCUMENTS

2006/0284560 A1 12/2006 Park et al.

FOREIGN PATENT DOCUMENTS

| | | |
|---|---|---|
| JP | 64-048851 | 3/1989 |
| JP | 03-261030 | 11/1991 |
| JP | 07-034587 | 6/1995 |
| JP | 2006-093011 | 4/2006 |
| JP | 2006 140036 | 6/2006 |
| JP | 2006-318841 | 11/2006 |
| JP | 2006 351529 | 12/2006 |
| JP | 2007-234551 | 9/2007 |
| WO | WO 2007/063628 | 6/2007 |

OTHER PUBLICATIONS

Japanese Office Action dated Feb. 25, 2009 with English translation of relevant parts.

*Primary Examiner* — Bumsuk Won
(74) *Attorney, Agent, or Firm* — Collard & Roe, P.C.

(57) ABSTRACT

A connecting member is adapted to be coupled with a connection object including a pipe portion having a sealed end and a terminal portion protruding outward from the sealed end. The connecting member includes a tubular portion adapted to be fitted over an outer peripheral surface of the pipe portion, a bottom portion connected to one end of the tubular portion in an axial direction and adapted to be faced to the sealed end when the tubular portion is fitted over the outer peripheral surface of the pipe portion, and a connecting portion connected to the bottom portion and adapted to be connected to the terminal portion. The tubular portion includes a plurality of elastic sections separated by a plurality of slits extending from the other end towards the one end in the axial direction and adapted to be brought into elastic contact with the pipe portion.

19 Claims, 6 Drawing Sheets

CONNECTING MEMBER IMPROVED IN ASSEMBLABILITY WITH RESPECT TO A CONNECTION OBJECT AND A COMBINATION THEREOF

This application claims priority to prior Japanese patent application JP 2007-160102, filed on Jun. 18, 2007, the disclosure of which is incorporated herein in its entirety by reference.

TECHNICAL FIELD

This invention relates to a connecting member adapted to be coupled with a connection object including a pipe portion having a sealed end and a terminal portion protruding outward from the sealed end, and to a combination of the connection object and the connecting member.

BACKGROUND ART

For example, JP-A-2006-351529 (Patent Document 1) corresp. to US-A-2006-284560 discloses a cold cathode fluorescent lamp comprising a lamp tube with a discharge gas injected therein, a fluorescent layer formed on an inner surface of the lamp tube, a pair of inner electrodes disposed inside of the lamp tube at opposite ends thereof, respectively, a pair of lead wires connected to the inner electrodes, respectively, and extended to the outside of the lamp tube, and a pair of conductive caps coupled with the opposite ends of the lamp tube and electrically connected to the lead wires, respectively. In the cold cathode fluorescent lamp, a conductive adhesive is arranged between the lead wires and the conductive caps.

JP-A-2006-140036 (Patent Document 2) discloses a fluorescent lamp comprising a glass bulb sealed at opposite ends, a pair of external electrodes each comprising a conductive layer and formed on an outer peripheral surface of the glass bulb at end portions thereof, a pair of cap-like or sleeve-like metal members surrounding outer peripheral surfaces of the external electrodes and connected thereto, respectively, and shutoff layers shutting off the external electrodes from external air. Each of the metal members has a slit extending in a longitudinal direction and is connected to the external electrode by elastic force of the metal member. The conductive layer of the external electrode is formed by the use of a conductive paste such as a silver paste and a nickel paste.

SUMMARY OF THE INVENTION

In the cold cathode fluorescent tube disclosed in Patent Document 1, the conductive cap is fixed to the lamp tube and electrically connected to the lead wire by the use of the conductive adhesive. Therefore, a step of applying the adhesive is additionally required so that the assemblability is inferior. Furthermore, since the lead wire is covered with the conductive cap, it is difficult to check a connecting state after connection. Therefore, stability of connection may not be satisfied. In addition, when the lamp tube is inserted into the conductive cap, the lead wire may cause buckling because of deflection of an end of the lead wire.

Since the conductive cap is kept in tight contact with the lamp tube, heat radiation from the opposite ends of the lamp tube with the internal electrodes arranged therein is promoted through the conductive caps. For example, if the discharge gas containing mercury is used, mercury is concentrated in an area around each of the internal electrodes to cause mercury condensation. Occurrence of the mercury condensation results in a reduced amount of light emission of the cold cathode fluorescent lamp.

In the fluorescent lamp disclosed in Patent Document 2, the conductive paste must be used. Therefore, a step of applying the conductive paste is additionally required so that the assemblability is inferior.

It is therefore an exemplary object of this invention to provide a connecting member improved in assemblability with respect to a connection object including a pipe portion having a sealed end and a terminal portion protruding outward from the sealed end.

It is another exemplary object of this invention to provide a combination of a connection object and a connecting member which is capable of preventing breakage and of reducing vibration noise and which is excellent in assemblability and reliability of connection.

Other objects of the present invention will become clear as the description proceeds.

According to an exemplary aspect of the present invention, there is provided a connecting member adapted to be coupled with a connection object including a pipe portion having a sealed end and a terminal portion protruding outward from the sealed end, the connecting member comprising a tubular portion which is adapted to be fitted over an outer peripheral surface of the pipe portion, a bottom portion which is connected to one end of the tubular portion in an axial direction and adapted to be faced to the sealed end when the tubular portion is fitted over the outer peripheral surface of the pipe portion, and a connecting portion which is connected to the bottom portion and adapted to be connected to the terminal portion, wherein the tubular portion includes a plurality of elastic sections which are separated by a plurality of slits extending from the other end towards the one end in the axial direction and which are adapted to be brought into elastic contact with the pipe portion.

According to another exemplary aspect of the present invention, there is provided a combination of a connection object and at least one connecting member coupled to the connection object, wherein the connection object comprises an insulating pipe portion which has two sealed ends and two conductive terminal portions which protrude outward from the sealed ends, respectively; wherein the at least one connecting member is made of a metal and comprises a tubular portion which is adapted to be fitted over an outer peripheral surface of the pipe portion, a bottom portion which is formed at an axial one end of the tubular portion and adapted to be faced to the sealed end when the tubular portion is fitted over the outer peripheral surface of the pipe portion, and a connecting portion which is connected to the bottom portion and adapted to be connected to the terminal portion, wherein the tubular portion has a plurality of elastic sections which are separated by a plurality of slits extending from the axial other end towards the axial one end and which are adapted to be brought into elastic contact with the pipe portion.

DESCRIPTION OF THE EXEMPLARY EMBODIMENTS

Figure 1:
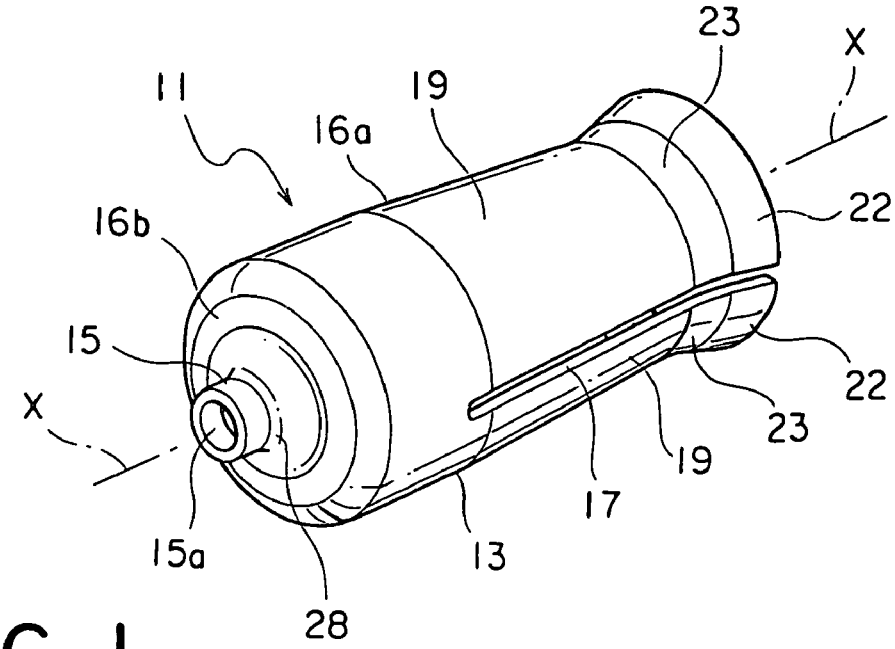
FIG. 1 is a perspective view of a connecting member according to a first exemplary embodiment of this invention.
Figure 2:
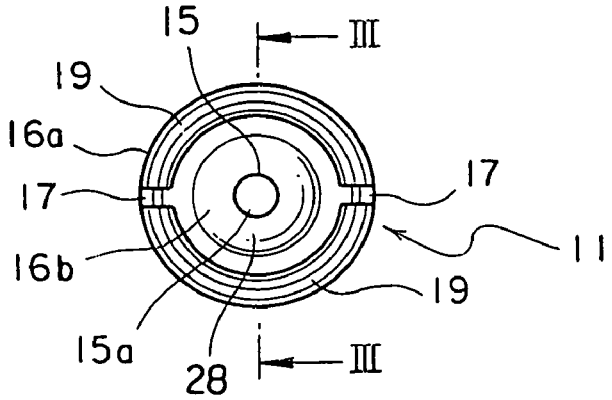
FIG. 2 is a right side view of the connecting member illustrated in FIG. 1.
Figure 3:
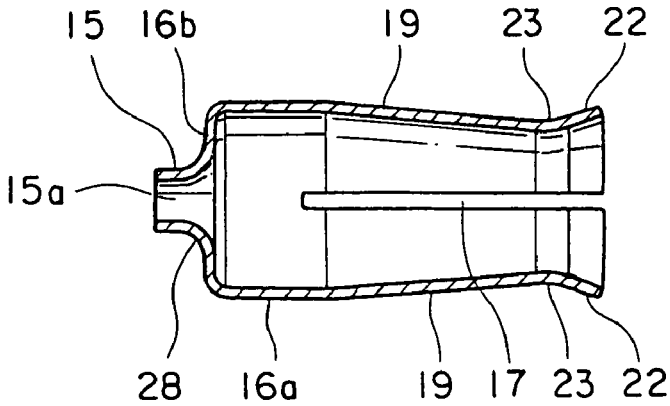
FIG. 3 is a sectional view taken along a line III-III in FIG. 2.

Referring to FIGS. 1 to 3, description will be made of a connecting member according to a first exemplary embodiment of this invention.

The connecting member 11 illustrated in the figures is made of a conductive material and comprises a main body 13 in the form of a bottomed cylinder and a connecting portion 15 connected to the main body 13. The main body 13 comprises a cylindrical tubular portion 16*a* having one end or a first end and the other end as a second end in an axis X direction (see FIG. 1), a bottom portion 16*b* formed at the one end of the tubular portion 16*a*, and a plurality of (two in the illustrated example) slits 17 formed in the tubular portion 16*a* at predetermined positions radially spaced from one another around an axis X and extending long in the axis X direction. The slits 17 extend in the axis X direction from an open end of the tubular portion 16*a* at the other end to the vicinity of the bottom portion 16*b* formed at the one end.

By forming the slits 17 in the tubular portion 16*a* of the main body 13, the tubular portion 16*a* is provided with a plurality of (two in the illustrated example) elastic sections 19. Each of the elastic sections 19 has a semicircular section on a plane perpendicular to the axis X.

The connecting portion 15 is a tubular protruding part protruding outward from the bottom portion 16*b* in the axis X direction. The connecting portion 15 has a through hole 15*a* penetrating the connecting portion 15 and the bottom portion 16*b* in the axis X direction.

The tubular portion 16*a* having the elastic sections 19 has a first guide portion 22 formed at the open end and a first pressing portion 23 adjacent to the first guide portion 22.

A connecting area between the bottom portion 16*b* and the connecting portion 15 serves as a second guide portion 28 which is a curved surface defined by an inner surface of the bottom portion 16*b* and an inner surface of the through hole 15*a*. The second guide portion 28 has a function which will later be described in relation to a connection object.

The tubular portion 16*a* comprising the elastic sections 19 has an inner diameter gradually reduced in the axis X direction from the one end adjacent to the bottom portion 16*b* to the first pressing portion 23 adjacent to the first guide portion 22. The guide portion 22 has a shape which makes the inner diameter of the tubular portion 16*a* be gradually increased from one end adjacent to the first pressing portion 23 towards the other end as an open end. The open end of the first guide portion 22 (i.e., the open end of the tubular portion 16*a*) has a greatest inner diameter as compared with a remaining part of the tubular portion 16*a*. The first pressing portion 23 has a smallest inner diameter as compared with the remaining part of the tubular portion 16*a*.

The connecting member 11 is made of a metal or an alloy. Desirably, the connecting member 11 is made of a stainless steel or nickel silver (may also be called albata). When the connecting member 11 is connected to a socket portion of a mating connecting member such as a connector, the connecting member 11 may be worn because of its sliding movement. Taking this into account, it is preferable that the connecting member 11 is not subjected to plating.

Referring to FIGS. 4 to 7 in addition, description will be made of the relationship between the connecting member 11 and a connection object 51 to be connected to the connecting member 11.

Figure 4:
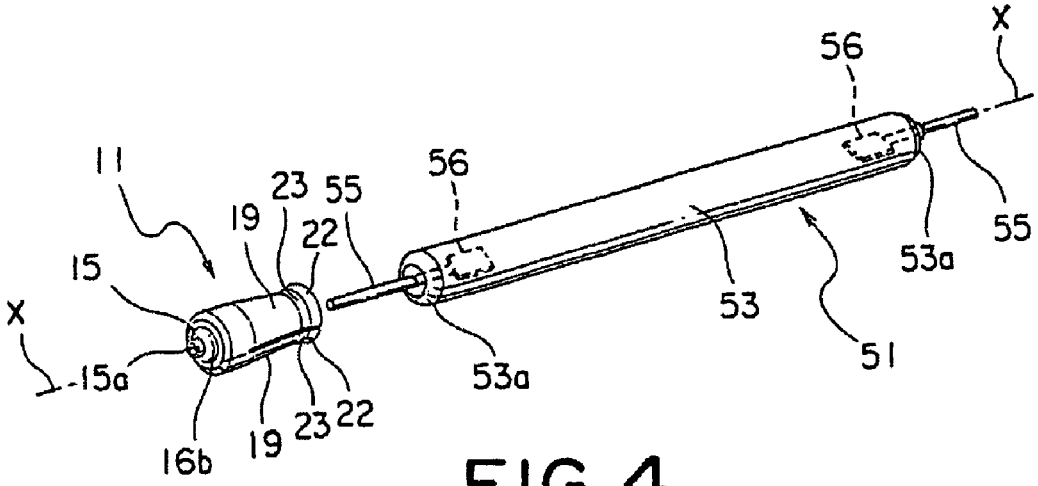
FIG. 4 is a perspective view of the connecting member illustrated in FIG. 1 in a state before it is connected to a connection object.

The connecting member 11 is connected to each of opposite ends of the connection object 51 in the axis X direction. In FIG. 4, the connecting member 11 is shown only at one end of the connection object 51 in the axis X direction. Although not shown in the figure, another connecting member same in structure as the connecting member 11 is connected to the other end of the connection object 51 in the axis X direction.

The connection object 51 used herein is a lamp such as a cold cathode fluorescent lamp. The connection object 51 comprises a long cylindrical pipe portion 53 having opposite ends as sealed ends 53*a*, a fluorescent layer (not shown) formed on an inner surface of the pipe portion 53, a pair of terminal portions 55 extending outward from the sealed ends 53*a* of the pipe portion 53 in the axis X direction, respectively, and a pair of internal electrodes 56 respectively connected to the terminal portions 55 and disposed inside the pipe portion 53. The pipe portion 53 is made of an electrically insulating material while the terminal portions 55 are made of a conductive material.

Each of the terminal portions 55 has one end connected to the internal electrode 56 and the other end extracted outward from the sealed end 53*a* of the pipe portion 53 in order connect an external lamp driving power supply (not shown) to the internal electrode 56. The pipe portion 53 need not have an I shape illustrated in the figure but may have an L shape or a U shape.

The fluorescent layer is excited by ultraviolet radiation generated by plasma discharge in the pipe portion 53 to emit visible light. For example, the internal electrode 56 is made of a metal, such as nickel (Ni), molybdenum (Mo), and niobium (Nb), having a low work function.

The pipe portion 53 is made of a transparent glass material so that the visible light generated inside is allowed to pass therethrough. A discharge gas containing a variety of gases and helping discharge of the lamp, namely, the cold cathode fluorescent lamp is injected into the pipe portion 53. For example, the discharge gas contains mercury (Hg), neon (Ne), argon (Ar), etc.

Figure 5:
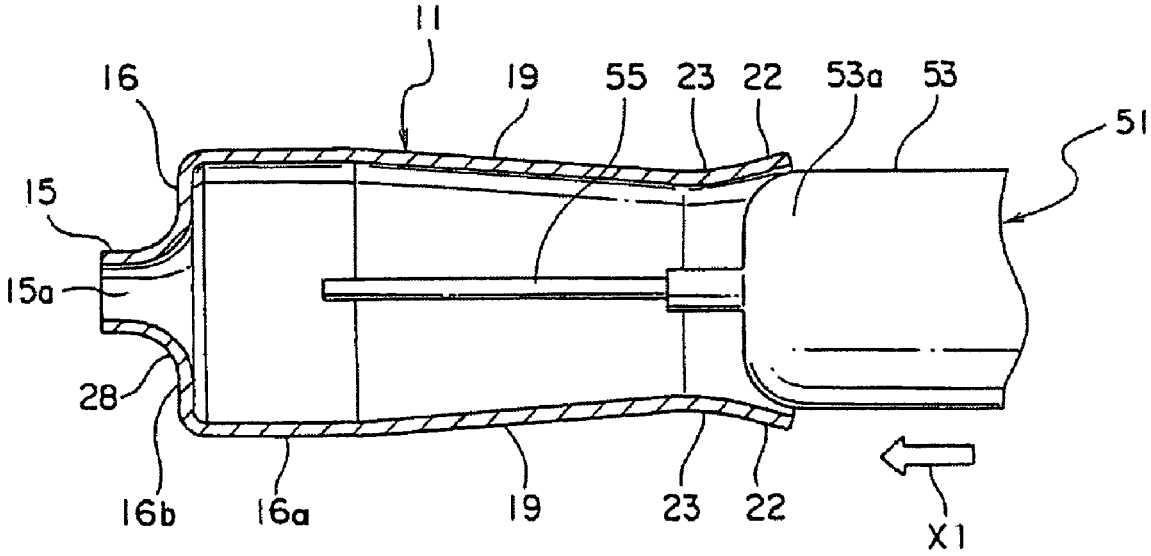
FIG. 5 is an enlarged sectional view of the connecting member illustrated in FIG. 1 in the middle of connection with the connection object.

FIG. 5 shows a state immediately before the connection object 51 is inserted into the connecting member 11 in an inserting direction X1 in the axis X direction. As shown in the figure, one of the terminal portions 55 of the connection object 51 is inserted into the tubular portion 16*a* of the connecting member 11 through its open end in the inserting direction X1. The open end of the first guide portion 22 has a diameter greater than an outer diameter of the pipe portion 53. With this structure, when the connection object 51 is inserted into the connecting member 11, each of the opposite ends including the sealed end 53*a* of the pipe portion 53 is guided into the open end of the first guide portion 22.

When the one terminal portion 55 of the connection object 51 is further inserted into the tubular portion 16*a* in the inserting direction X1, the sealed end 53*a* and the outer peripheral surface of the pipe portion 53 are successively contacted with an inner surface of the first pressing portion 23 of the tubular portion 16*a*. Since the first pressing portion 23 as a part of the elastic sections 19 is divided by the slits 17, the elastic sections 19 are elastically deformed and displaced.

The inner diameter of the first pressing portion 23 is selected to be smaller than the outer diameter of the pipe portion 53. With this structure, the outer peripheral surface of the pipe portion 53 can be brought into contact with the inner surface of the first pressing portion 23.

When the one terminal portion 55 of the connection object 51 is further inserted into the tubular portion 16*a* in the inserting direction X1, the terminal portion 55 is inserted into the through hole 15*a* of the connecting portion 15. At this time, the outer peripheral surface of the pipe portion 53 is in sliding contact with the first pressing portion 23.

Since the outer peripheral surface of the pipe portion 53 presses the first pressing portion 23, the elastic sections 19 of the tubular portion 16*a* are elastically deformed and displaced radially outward to increase the inner diameter of the tubular portion 16*a*. After the connection object 51 is connected to the connecting member 11, a protruding part of the terminal portion 55 which protrudes outward from the connecting portion 15 is cut off. Then, the connecting portion 15 is connected to the terminal portion 55 exposed at the through hole 15*a* after the protruding part is cut off. The connecting portion 15 is connected to the terminal portion 55 by means of soldering, laser welding, crimping (pressure bonding), pressure welding, and so on. Thus, the connecting member 11 and the terminal portion 55 are electrically and mechanically connected to each other.

Figure 6:
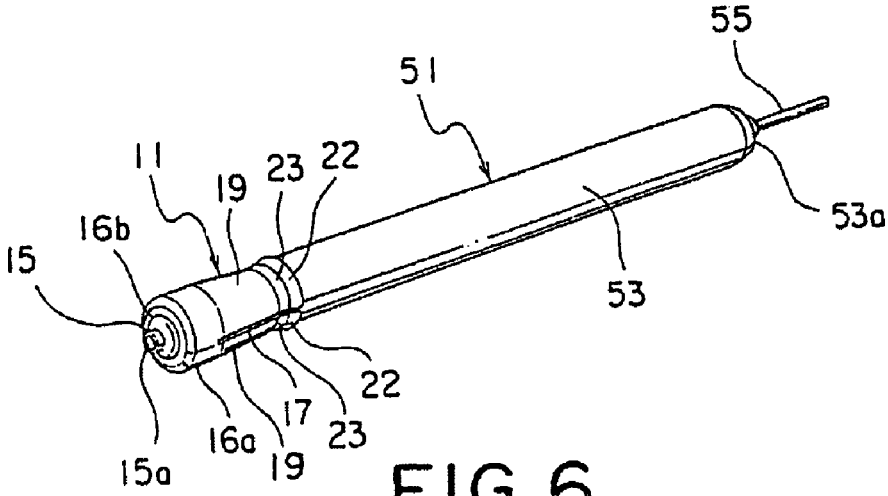
FIG. 6 is a perspective view of the connecting member illustrated in FIG. 1 in a state after it is connected to the connection object.
Figure 7:
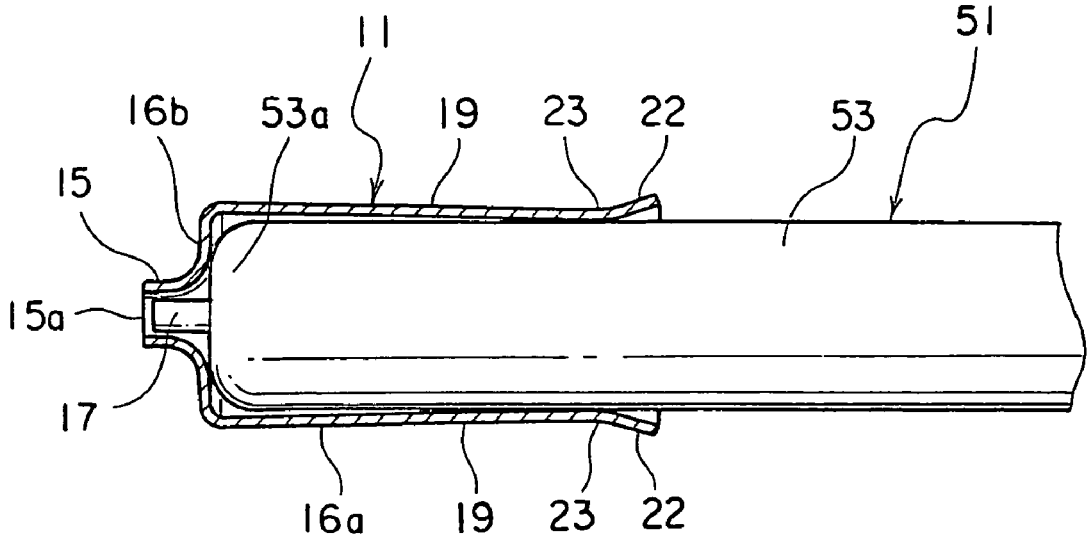
FIG. 7 is an enlarged view of a characteristic part in FIG. 6, partially in section.

As shown in FIGS. 6 and 7, the connection object 51 and the connecting member 11 are connected to each other. At this time, an end face of the sealed end 53*a* of the connection object 51 is brought into contact with an inner surface of the bottom portion 16*b*.

At the one end adjacent to the bottom portion 16*b*, the tubular portion 16*a* has an inner diameter slightly greater than the outer diameter of the pipe portion 53. The inner diameter of the first pressing portion 23 is designed to be smaller than the outer diameter of the pipe portion 53. Therefore, as illustrated in FIG. 7, the first pressing portion 23 is pressed by the pipe portion 53 and widened outward so that the elastic sections 19 of the tubular portion 16*a* are deformed largely around the first pressing portion 23 to become substantially in parallel with the outer peripheral surface of the pipe portion 53.

Thus, a part of the pipe portion 53 and the first pressing portion 23 are kept in tight contact without any gap. Furthermore, the terminal portion 55 is fixed to the connecting portion 15. Therefore, upon occurrence of vibration, it is possible to prevent breakage of the pipe portion 53 and generation of vibration noise during contacting.

As illustrated in FIG. 7, a gap as an air layer is formed between the inner surface of the tubular portion 16*a* and the outer peripheral surface of the pipe portion 53 except a contacting area around the first pressing portion 23. It is therefore possible to prevent, for example, mercury condensation in the pipe portion 53 with the discharge gas such as mercury injected therein.

Figure 8:
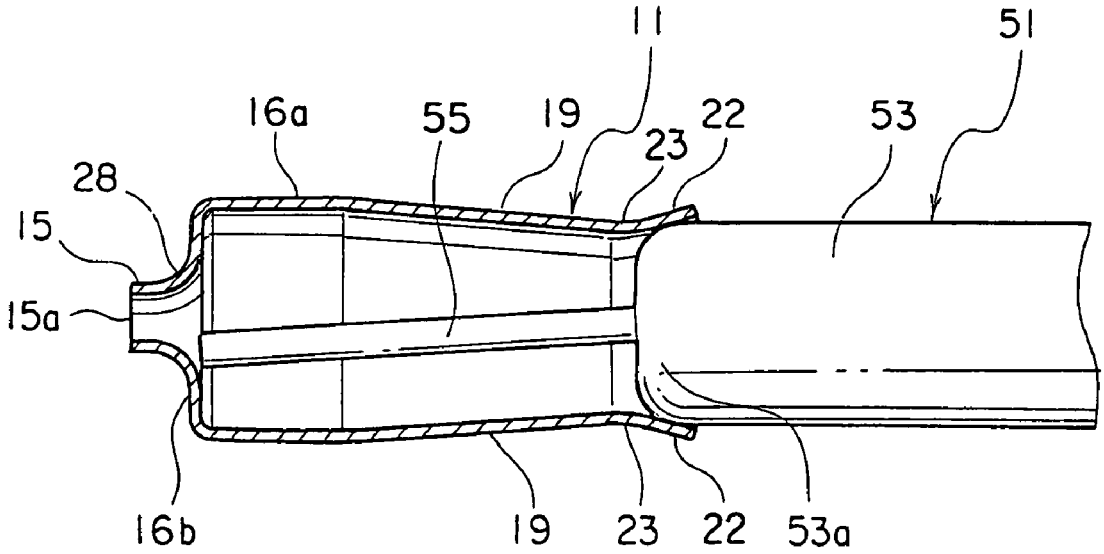
FIG. 8 is an enlarged sectional view showing a state where a terminal portion of the connection object is inserted out of alignment from the connecting member.

FIG. 8 shows a state where the connection object 51 is inserted into the connecting member 11 with the terminal portion 55 out of alignment from the axis X of the connecting member 11. As shown in FIG. 8, it is assumed that the terminal portion 55 is deflected in a direction intersecting with the axis X and, in this state, inserted into the connecting member 11. At this time, an end of the terminal portion 55 is out of alignment with respect to the through hole 15*a* of the connecting portion 15 and, therefore, the terminal portion 55 may not be inserted into the through hole 15*a*.

However, because the second guide portion 28 has a curved inner surface at the connecting area between the bottom portion 16*b* and the connecting portion 15, the end of the terminal portion 55 is contacted with the second guide portion 28 during insertion as shown in FIG. 8 and is guided into the through hole 15*a* of the connecting portion 15.

Figure 9:
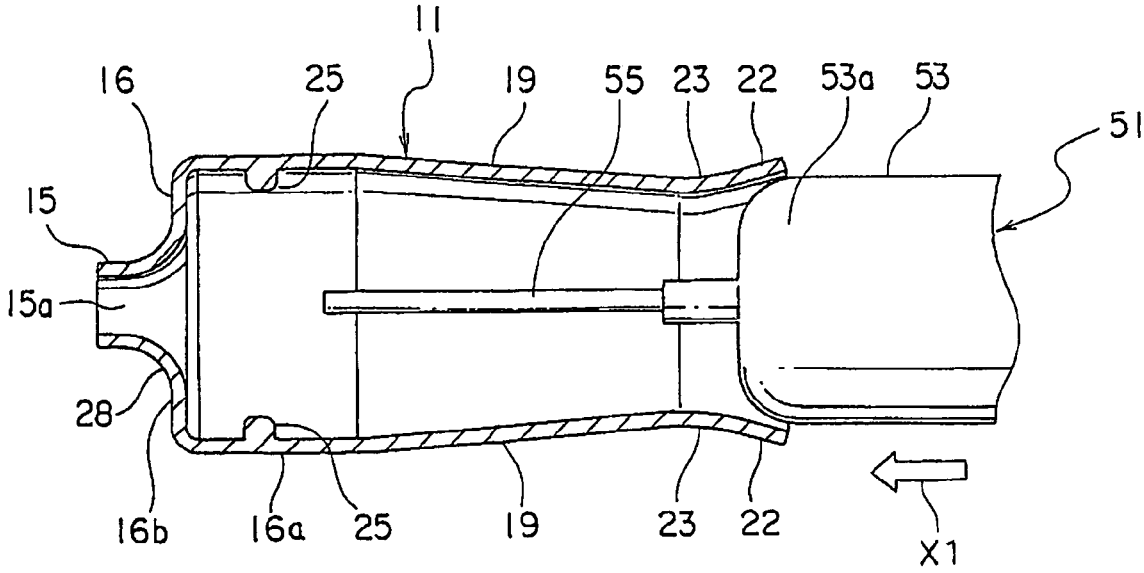
FIG. 9 is an enlarged sectional view of a modification of the connecting member illustrated in FIG. 1 together with the connection object.

Referring to FIG. 9, a modification of the connecting member 11 has a positioning portion 25 formed on the inner surface of the tubular portion 16*a* of the main body 13. The positioning portion 25 is formed near the bottom portion 16*b* and protrudes from the inner surface of the tubular portion 16*a* in a direction intersecting with the axis X. When the connection object 51 is inserted into the connecting member 11, the sealed end 53*a* of the pipe portion 53 of the connection object 51 is brought into contact with the positioning portion 25.

Thus, the connection object 51 is brought into contact with the positioning portion 25 formed in the tubular portion 16*a* of the connecting member 11 to be properly positioned at a predetermined position in the inserting direction X1. Therefore, the connection object 51 and the connecting member 11 can be connected without variation in position. In other words, the positioning portion 25 serves to suppress variation in positional relationship between the connecting member 11 and the connection object 51 in the axis X direction at the time of connection.

Figure 10:
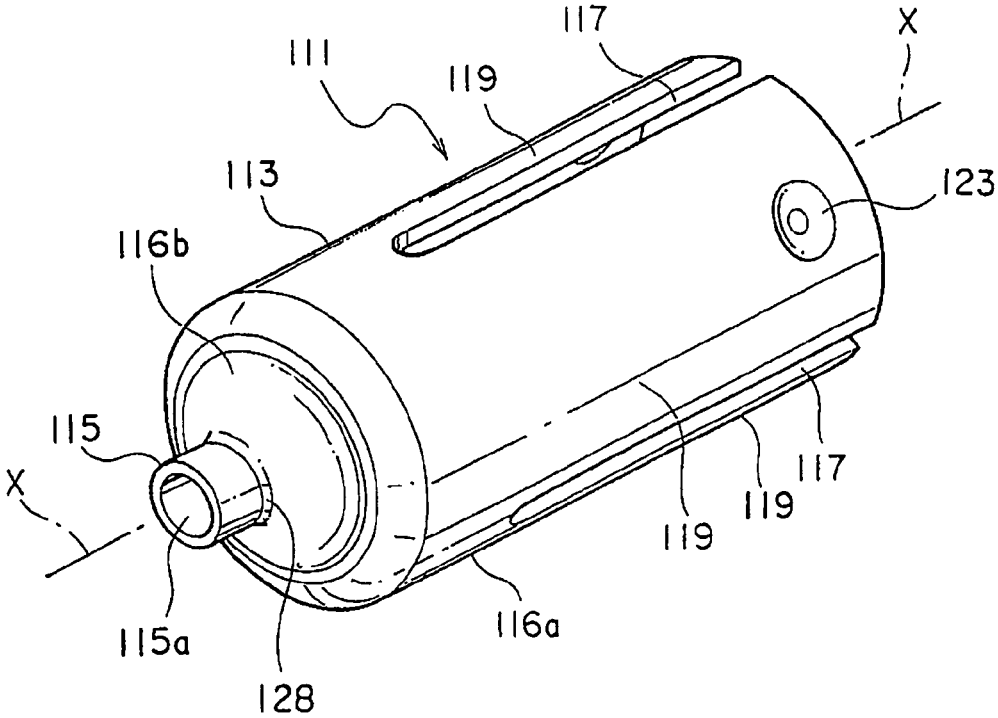
FIG. 10 is a perspective view of a connecting member according to a second exemplary embodiment of this invention.
Figure 11:
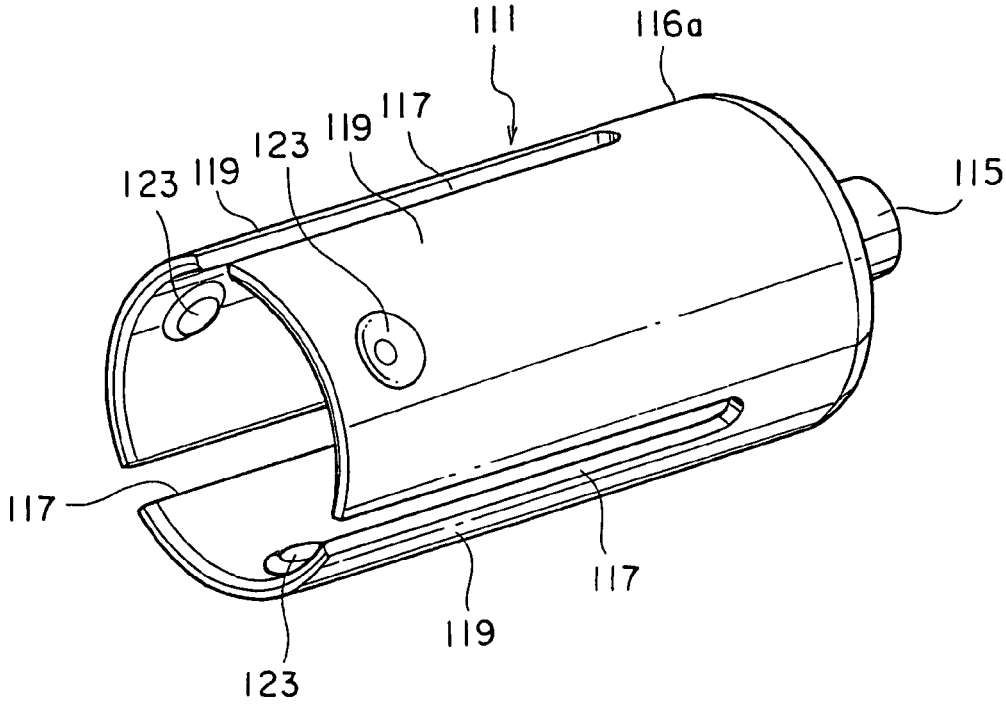
FIG. 11 is a perspective view of the connecting member illustrated in FIG. 10 but reversed in position in an axial direction.

Referring to FIGS. 10 and 11, description will be made of a connecting member according to a second exemplary embodiment of this invention.

The connecting member 111 illustrated in the figures comprises a main body 113 in the form of a bottomed cylinder and a connecting portion 115 connected to the main body 113. The main body 113 has a cylindrical tubular portion 116*a* having one end and the other end in an axis X direction (see FIG. 10), a bottom portion 116*b* formed at the one end of the tubular portion 116*a*, and a plurality of (three in the illustrated example) slits 117 formed in the tubular portion 116*a* at predetermined positions radially spaced from one another around an axis X and extending long in the axis X direction. The slits 117 extend in the axis X direction from an open end of the tubular portion 116*a* at the other end to the vicinity of the bottom portion 116*b* formed at the one end.

By forming the slits 117 in the tubular portion 116*a* of the main body 113, the tubular portion 116*a* is provided with a plurality of (three in the illustrated example) elastic sections 119.

The connecting portion 115 is a tubular protruding part protruding outward from the bottom portion 116*b* in the axis X direction. The connecting portion 115 has a through hole 115*a* penetrating the connecting portion 115 and the bottom portion 116*b* in the axis X direction.

Each of the elastic sections 119 of the tubular portion 116*a* is provided with a second pressing portion 123 formed near the open end. The second pressing portion 123 protrudes inward from an inner surface of the elastic section 119 in a direction intersecting with the axis X. A connecting area between the bottom portion 116*b* and the connecting portion 115 serves as a second guide portion 128 which is a curved surface defined by an inner surface of the bottom portion 116*b* and an inner surface of the through hole 115*a*. The tubular portion 116*a* has a fixed inner diameter on a plane perpendicular to the axis X throughout its entire length in the axis X direction.

Figure 12:
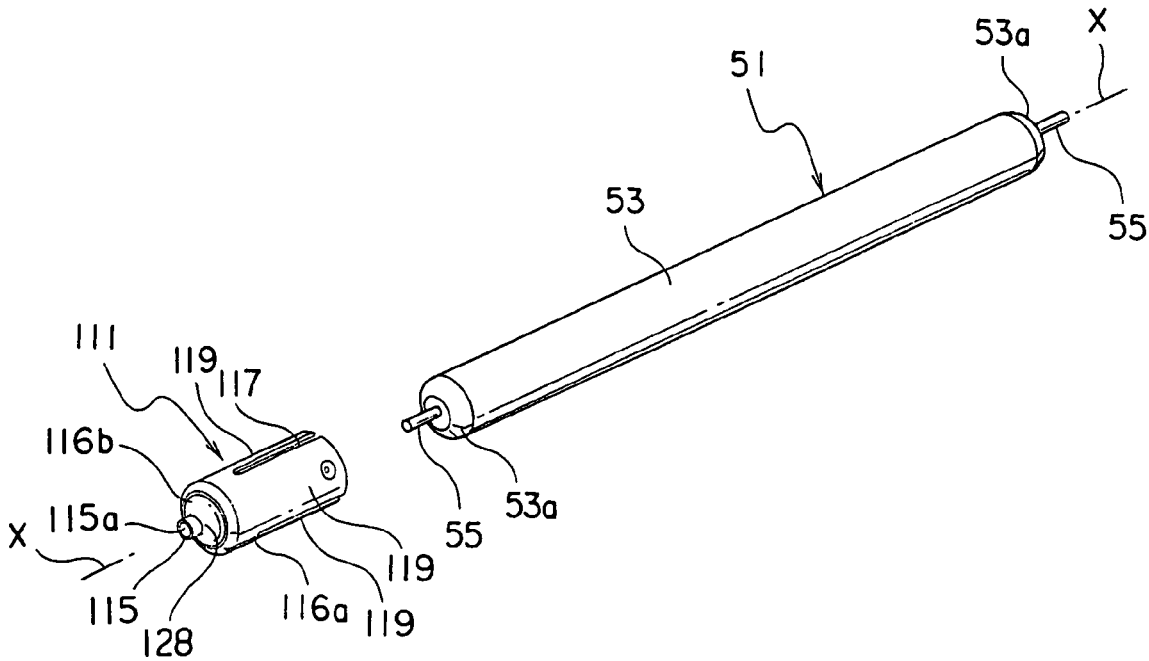
FIG. 12 is a perspective view of the connecting member illustrated in FIG. 10 in a state before it is connected to a connection object.

Referring to FIG. 12, the connecting member 111 is shown together with the connection object 51 to be connected to the connecting member 111. FIG. 12 shows a state before the connection object 51 is inserted into the connecting member 111 in the axis X direction. The connection object 51 in the second embodiment is a lamp same as that described in connection with the first embodiment.

The connecting member 111 is connected to each of opposite ends of the connection object 51 in the axis X direction. In FIG. 12, the connecting member 111 is shown only at one end of the connection object 51 in the axis X direction. Although not shown in the figure, another connecting member same in shape as the connecting member 111 is connected to the other end of the connection object 51 in the axis X direction.

As shown in FIG. 12, one of the terminal portions 55 of the connection object 51 is inserted into the tubular portion 116*a* of the connecting member 111 through its open end. The tubular portion 116*a* has an inner diameter greater than the outer diameter of the pipe portion 53. With this structure, the sealed end 53*a* of the pipe portion 53 is guided into the open end of the tubular portion 116*a*.

When the one terminal portion 55 of the connection object 51 is further inserted into the tubular portion 116*a*, the sealed end 53*a* of the pipe portion 53 and the outer peripheral surface of the pipe portion 53 are successively contacted with the second pressing portions 123 formed on the elastic sections 119 of the tubular portion 116*a*.

Each of the second pressing portions 123 has a curved shape. An inner diameter of a circle defined by apexes of the second pressing portions 123, three in number, is smaller than the outer diameter of the pipe portion 53. With this structure, the outer peripheral surface of the pipe portion 53 is brought into contact with the second pressing portions 123 at three points.

When the one terminal portion 55 of the connection object 51 is further inserted into the tubular portion 116*a* in the inserting direction X1, the terminal portion 55 is inserted into the through hole 115*a* of the connecting portion 115. At this time, the pipe portion 53 is inserted while the outer peripheral surface of the pipe portion 53 is kept in sliding contact with the second pressing portions 123.

Figure 13:
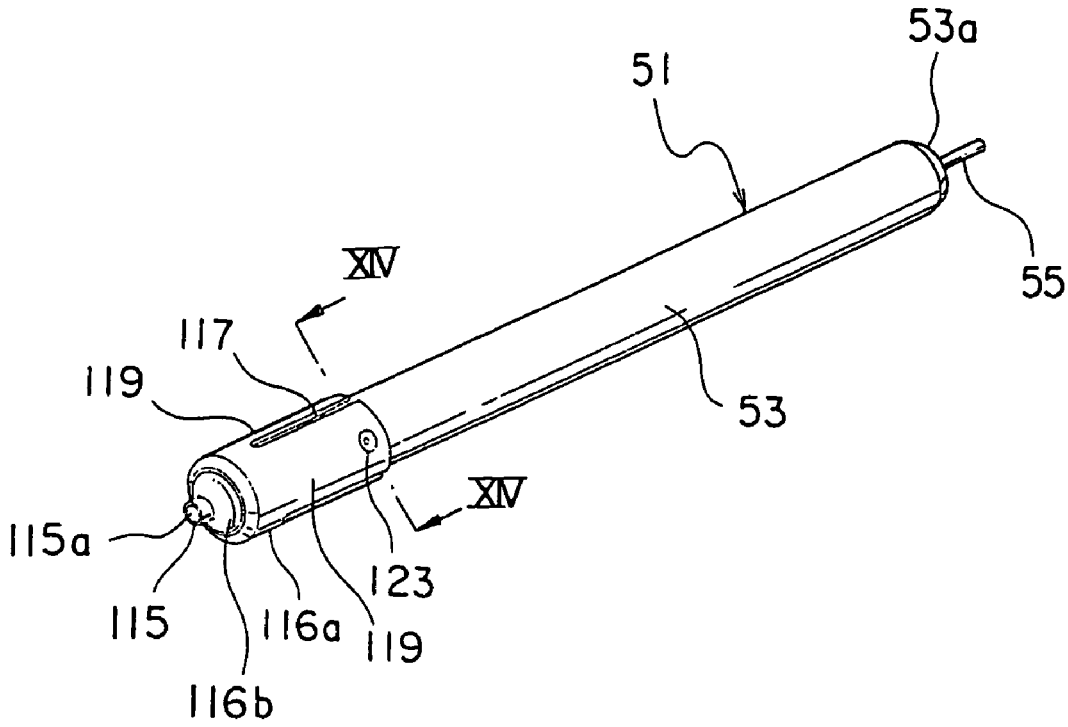
FIG. 13 is a perspective view of the connecting member illustrated in FIG. 10 in a state after it is connected to the connection object.
Figure 14:
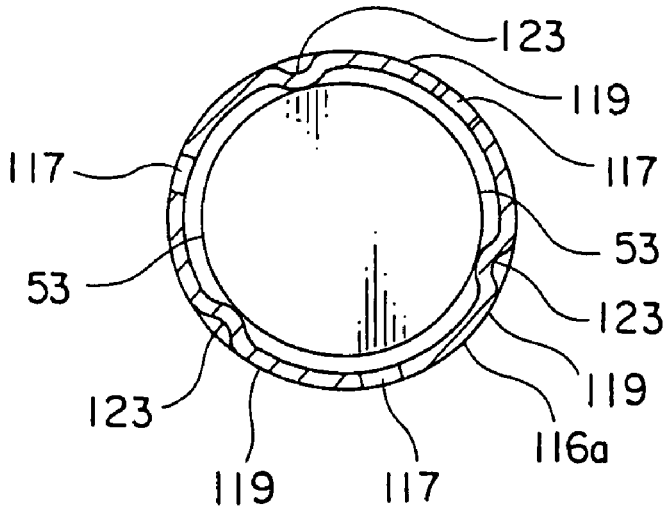
FIG. 14 is an enlarged sectional view taken along a line XIV-XIV in FIG. 13.

Since the outer peripheral surface of the pipe portion 53 presses the second pressing portions 123, the elastic sections 119 are elastically deformed and displaced so that the inner diameter of the tubular portion 116*a* is slightly increased. In this state, the pipe portion 53 is contacted with the elastic sections 119. As illustrated in FIGS. 13 and 14, the connection object 51 is connected to the connecting member 111. At this time, the end face of the sealed end 53*a* of the connection object 51 is brought into contact with an inner surface of the bottom portion 116*b*.

After the connection object 51 is connected to the connecting member 111, the connecting portion 115 and the terminal portion 55 exposed at the through hole 115*a* are connected to each other. The connecting portion 115 and the terminal portion 55 are connected in the manner similar to that described in connection with the first exemplary embodiment.

After completion of the connection, the pipe portion 53 and the second pressing portions 123 are kept in tight contact without any gap. Furthermore, the terminal portion 55 is fixed to the connecting portion 115. Therefore, upon occurrence of vibration, it is possible to prevent breakage of the pipe portion 53 and generation of vibration noise during contacting.

The tubular portion 116*a* may be designed to have an inner diameter greater than the outer diameter of the pipe portion 53. On the other hand, the inner diameter of the circle defined by the apexes of the second pressing portions 123 is designed to be smaller than the outer diameter of the pipe portion 53. In this event, the elastic sections 119 having the second pressing portions 123 are pressed by the outer peripheral surface of the pipe portion 53 to be elastically deformed and displaced. In this state, a gap is formed between the inner peripheral surface of the tubular portion 116*a* and the outer peripheral surface of the pipe portion 53 as illustrated in FIG. 14.

Thus, the gap as an air layer is formed between the inner surface of the tubular portion 116*a* and the outer peripheral surface of the pipe portion 53 except those areas around the second pressing portions 123. It is therefore possible to prevent, for example, mercury condensation in the pipe portion 53 with the discharge gas such as mercury injected therein.

It is assumed that the connection object 51 is inserted into the connecting member 111 out of alignment from the axis X. As described in connection with FIG. 8, the second guide portion 28 has a curved inner surface at the connecting area between the bottom portion 116*b* and the connecting portion 115, the end of the terminal portion 55 is contacted with the second guide portion 28 and is guided into the through hole 115*a* of the connecting portion 115 in the inserting direction X1.

In the connecting member 111 in the second embodiment also, a positioning portion similar to the positioning portion 25 illustrated in FIG. 9 may be formed in the tubular portion 116*a* of the main body 113 so that the sealed end 53*a* of the pipe portion 53 of the connection object 51 is brought into contact with the positioning portion when the connection object 51 is inserted into the connecting member 111.

The above-mentioned connecting member has a spring structure since the connecting member has a plurality of elastic sections. Furthermore, the elastic sections of the connecting member are brought into elastic contact with the pipe portion of the connection object and the terminal portion of the connection object is fixed to the connecting portion. Thus, as the connecting member and the pipe portion of the connection object are brought into contact with each other, it is possible to prevent breakage of the connection object and generation of vibration noise. When the connecting member is connected to the connection object, it is only required to bring the elastic sections into elastic contact with the pipe portion of the connection object and to connect the terminal portion of the connection object to the connecting portion. Thus, assemblability is excellent.

A combination of the connection object and the connecting member mentioned above may be used as a backlight assembly of a liquid crystal display, a cold cathode fluorescent lamp for use in an OA apparatus, such as a facsimile machine and a copying machine, a dielectric barrier discharge lamp comprising a plurality of lamps which can be lit by a single high-frequency electronic ballast.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims.

What is claimed is:

1. A connecting member adapted to be coupled with a connection object including a pipe portion having a sealed end and a terminal portion protruding outward from the sealed end, the connecting member comprising:

a tubular portion which is adapted to be fitted over an outer peripheral surface of the pipe portion;

a bottom portion which is connected to a first end of the tubular portion in an axial direction and adapted to be faced to the sealed end when the tubular portion is fitted over the outer peripheral surface of the pipe portion; and a connecting portion which is connected to the bottom portion and adapted to be connected to the terminal portion;

wherein the tubular portion includes a plurality of elastic sections which are separated by a plurality of slits extending from a second end of the tubular portion towards the first end in the axial direction, wherein the tubular portion comprises a pressing portion which is formed to the elastic sections at a position separated from the second end, and wherein the pressing portion has a smallest inner diameter and is adapted to be brought into elastic contact with the pipe portion.

2. The connecting member according to claim 1, wherein the tubular portion comprises a first guide portion formed at the second end and having an inner diameter greater than an outer diameter of the pipe portion.

3. The connecting member according to claim 1, wherein the smallest inner diameter is smaller than an outer diameter of the pipe portion.

4. The connecting member according to claim 1, wherein the pressing portion comprises a protruding portion protruding inward from an inner surface of the tubular portion.

5. The connecting member according to claim 1, wherein each of the slits extends to the vicinity of the first end.

6. The connecting member according to claim 1, wherein the tubular portion has a circular cylindrical shape, and each of the elastic sections is curved along the circular cylindrical shape.

7. The connecting member according to claim 6, wherein each of the elastic sections comprises a protruding portion protruding inward, and the protruding portion serves as a pressing portion for pressing the pipe portion.

8. The connecting member according to claim 1, wherein the connecting portion protrudes outward from the bottom portion and has an inner surface defining a through hole adapted to receive the terminal portion when the tubular portion is fitted over the outer peripheral surface of the pipe portion.

9. The connecting member according to claim 8, wherein the inner surface has an end region and has a second region nearer to the bottom portion than the end region;

wherein the inner surface has a first diameter at the end region and a second diameter at the second region; and wherein the inner surface has a curved surface so that the second diameter is wider than the first diameter.

10. A combination of a connection object and at least one connecting member coupled to the connection object, wherein:

the connection object comprises:

an insulating pipe portion which has two sealed ends; and two conductive terminal portions which protrude outward from the sealed ends, respectively;

wherein the at least one connecting member is made of a metal and comprises:

a tubular portion which is adapted to be fitted over an outer peripheral surface of the pipe portion;

a bottom portion which is formed at an axial first end of the tubular portion and adapted to be faced to the sealed end when the tubular portion is fitted over the outer peripheral surface of the pipe portion; and a connecting portion which is connected to the bottom portion and adapted to be connected to the terminal portion;

wherein the tubular portion has a plurality of elastic sections which are separated by a plurality of slits extending from an axial second end of the tubular portion towards the axial first end, wherein the tubular portion comprises a pressing portion which is formed to the elastic sections at a position separated from the second end, and wherein the pressing portion has a smallest inner diameter and is brought into elastic contact with the pipe portion.

11. A connecting member adapted to be coupled with a connection object including a pipe portion having a sealed end and a terminal portion protruding outward from the sealed end, the connecting member comprising:

a tubular portion which is adapted to be fitted over an outer peripheral surface of the pipe portion;

a bottom portion which is connected to a first end of the tubular portion in an axial direction and adapted to be faced to the sealed end when the tubular portion is fitted over the outer peripheral surface of the pipe portion; and a connecting portion which is connected to the bottom portion and adapted to be connected to the terminal portion;

wherein the tubular portion includes a plurality of elastic sections which are separated by a plurality of slits extending from a second end of the tubular portion towards the first end in the axial direction, wherein each of the elastic sections comprises a protruding portion which is formed at a particular region separated from the second end and protrudes inward from an inner surface of the tubular portion, wherein the protruding portion is adapted to be brought into elastic contact with the pipe portion with each of the elastic sections being elastically bent outwardly and to serve as a pressing portion for pressing the pipe portion.

12. The connecting member according to claim 11, wherein the tubular portion comprises a first guide portion formed at the second end and having an inner diameter greater than an outer diameter of the pipe portion.

13. The connecting member according to claim 11, wherein the protruding portion protrudes inward from the inner surface of the tubular portion to a circle, which is concentric with the tubular portion and has a diameter smaller than an outer diameter of the pipe portion.

14. The connecting member according to claim 11, wherein each of the slits extends to the vicinity of the first end.

15. The connecting member according to claim 11, wherein the tubular portion has a circular cylindrical shape, and each of the elastic sections is curved along the circular cylindrical shape.

16. The connecting member according to claim 11, wherein the connecting portion protrudes outward from the bottom portion and has an inner surface defining a through hole adapted to receive the terminal portion when the tubular portion is fitted over the outer peripheral surface of the pipe portion.

17. The connecting member according to claim 16, wherein the inner surface has an end region and has a second region nearer to the bottom portion than the end region;

wherein the inner surface has a first diameter at the end region and a second diameter at the second region; and wherein the inner surface has a curved surface so that the second diameter is wider than the first diameter.

18. The connecting member according to claim 11, wherein the particular region is near the second end rather than the first end in the axial direction, and the tubular portion has an inner surface smoothly formed between the particular region and the first end in the axial direction.

19. A combination of a connection object and at least one connecting member coupled to the connection object, wherein:

the connection object comprises:

an insulating pipe portion which has two sealed ends; and two conductive terminal portions which protrude outward from the sealed ends, respectively;

wherein the at least one connecting member is made of a metal and comprises:

a tubular portion which is adapted to be fitted over an outer peripheral surface of the pipe portion;

a bottom portion which is connected to a first end of the tubular portion in an axial direction and adapted to be faced to the sealed end when the tubular portion is fitted over the outer peripheral surface of the pipe portion; and a connecting portion which is connected to the bottom portion and adapted to be connected to the terminal portion;

wherein the tubular portion includes a plurality of elastic sections which are separated by a plurality of slits extending from a second end of the tubular portion towards the first end in the axial direction, wherein each of the elastic sections comprises a protruding portion which is formed at a particular region separated from the second end and protrudes inward from an inner surface of the tubular portion, wherein the protruding portion is adapted to be brought into elastic contact with the pipe portion with each of the elastic sections being elastically bent outwardly and to serve as a pressing portion for pressing the pipe portion.

* * * * *